US006262693B1

(12) United States Patent
Sutter et al.

(10) Patent No.: US 6,262,693 B1
(45) Date of Patent: Jul. 17, 2001

(54) SNAP FIT COMPRESSION ANTENNA ASSEMBLY

(75) Inventors: Rob Sutter, Wheeling; Umesh Navsariwala, Schaumburg; Dan Repplinger, Hawthorn Woods, all of IL (US)

(73) Assignee: T&M Antennas, Vernon Hills, IL (US)

( * ) Notice: Subject to any disclaimer, the term of this patent is extended or adjusted under 35 U.S.C. 154(b) by 0 days.

(21) Appl. No.: 09/304,514

(22) Filed: May 3, 1999

(51) Int. Cl.[7] ..... H01Q 1/36
(52) U.S. Cl. ..... 343/895; 343/702; 343/872
(58) Field of Search ..... 343/895, 702, 343/872, 906

(56) References Cited

U.S. PATENT DOCUMENTS 5,436,633 * 7/1995 Liu ..... 343/702
5,742,259 * 4/1998 Annamaa ..... 343/895
5,945,964 * 8/1999 DeGroot et al. ..... 343/895
5,963,170 * 10/1999 Garner et al. ..... 343/702
6,016,130 * 1/2000 Annamaa ..... 343/895
6,052,088 * 4/2000 Simmons et al. ..... 343/702
6,075,488 * 6/2000 Hope ..... 343/702
6,100,847 * 6/2000 Sonitula ..... 343/702

* cited by examiner

*Primary Examiner*—Tan Ho
*Assistant Examiner*—Ephrem Alemu
(74) *Attorney, Agent, or Firm*—Greer, Burns & Crain, Ltd.

(57) ABSTRACT

An antenna structure incorporating a unitary radiator including a compression housing. The compression housing snap fits to a ferrule to compress the unitary radiator to ensure electrical contact between the unitary radiator and an electrical contact, such as the ferrule. Upon assembly, the compression housing is snap fit to the ferrule to compress the radiator. Preferably, to accommodate snap fit construction, an end of the ferrule includes at least one detent that corresponds to at least one projection on the compression housing. Another end of the ferrule preferably includes at least one projection that corresponds to at least one detent on the portable communicator to achieve a snap fit between the ferrule and the portable communicator. To accommodate two bands, the unitary radiator preferably has a generally helical shape formed by an outer portion thereof and a center portion disposed within the outer portion.

18 Claims, 4 Drawing Sheets

Fig. 2A
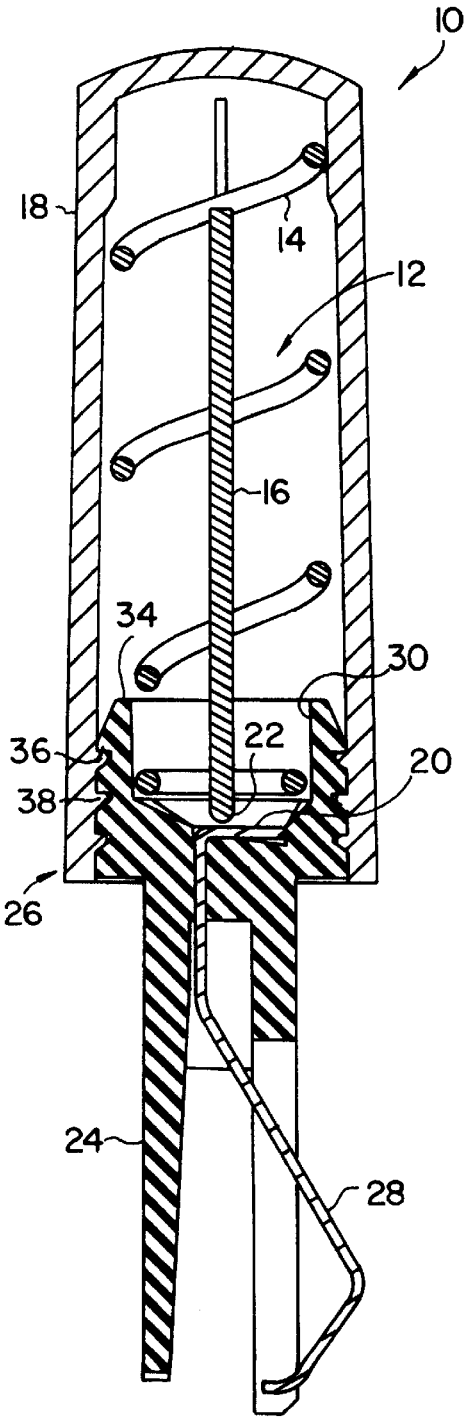
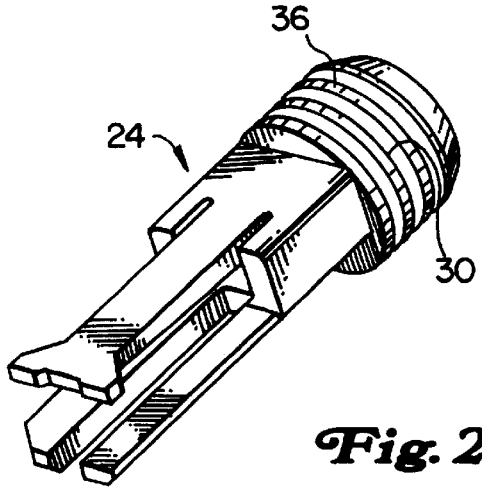
Fig. 2B
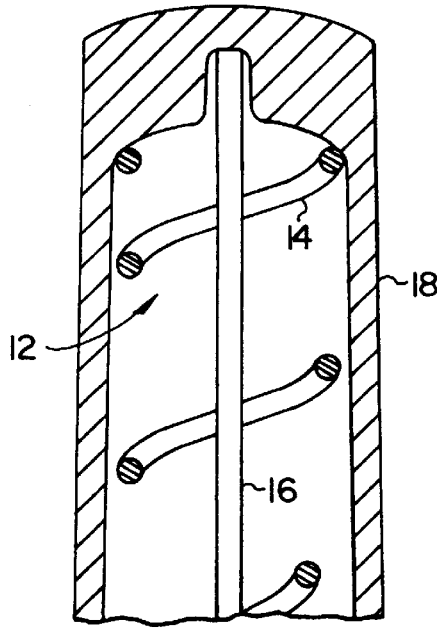
Fig. 2C

SNAP FIT COMPRESSION ANTENNA ASSEMBLY

FIELD OF THE INVENTION

The present invention generally concerns antennas for a portable communicator. The present invention also concerns multiple band antennas.

BACKGROUND OF THE INVENTION

Portable communicators, such as cell phones, sometimes use antennas with multiple radiators to enable phones to receive two different signal bands. These phones are compatible then with multiple cellular networks or different frequency services of a single cellular network. Such an antenna includes a first frequency radiator and second radiator which are alternately utilized through mechanical switching methods in typical devices. Frequently, one radiator might be active in a retracted position and another in an extended position.

Known techniques for connecting radiators to phone circuit contacts in such antennas include soldering and crimping to electrically connect radiators to electrodes or similar means which electrically couple to circuits of the portable communicators. A problem exists in that techniques such as soldering and crimping change the electrical characteristics of the antenna in a manner which may vary from one manufactured antenna to the next. For example, the process of adding solder to the antenna is an inherently imprecise venture since the solder adds variable amounts materials to the radiators which change the electrical characteristics of one manufactured antenna to the next. Additionally, crimping is not a desired technique since crimping can cause the radiator to deform, thus adversely affecting the electrical characteristics of the antenna. The latter problem is typically experienced when the pitch of a helical radiator is altered due to mechanical deformation during attachment.

Compensation for these variances is often achieved through additional processing, such as testing and trimming to tune the antenna to a desired frequency. Obviously, this increases both the cost and difficulty of manufacturing the antennas. In addition, operations such as soldering and crimping require assembly technicians skilled enough to perform the delicate and time-consuming techniques. Additionally, performance tolerances must be generous enough to accommodate the variances experienced in those antennas which are still suitable for use. Even so, a significant percentage of manufactured antennas may be unsuitable for use.

Related difficulties relate to high part counts and overall device complexity. It is generally desirable to reduce part counts because of the obvious benefits that such reduction has on manufacturing. In typical multiple band antennas, high part counts are often associated with the switching and connecting mechanisms to activate separate radiators for operation in separate bands.

Operation of known multiple band antennas is also limited since their structure typically requires some operator movement of the antenna to activate one radiator for one band of operation and deactive its other radiator for another band of operation. This conflicts with a trend in the art towards small fixed antennas, referred to as "stubbies". It also limits usefulness of the antennas since one band's operation is mutually exclusive of the other band's operation.

There is therefore a need for an improved portable communicator antenna which addresses problems in such known antennas. It is an object of the invention to provide an antenna which meets this need.

SUMMARY OF THE INVENTION

This object is met or exceeded by the present multiple band, unitary radiator antenna. The present antenna for portable communicators radiates and receives two frequency bands through the use of the unitary, i.e., one piece, radiator. Separate portions of the radiator correspond to separate frequency bands, with the separate portions being electrically parallel and reacting with each other.

Preferred structures of the present invention provide such desirable multiple band operation while also separately demonstrating advantageous manufacturing characteristics. Low part counts and low sophistication assembly result from the present structure. In addition, preferred structures of the invention provide reliable manufacturing tolerances facilitating consistent electrical performance from one manufactured antenna to the next.

More specifically, a preferred antenna structure incorporating the unitary radiator of the present invention or another radiator includes a compression housing. The compression housing compresses the unitary radiator to ensure electrical contact between the unitary radiator and an electrical contact, such as a ferrule. Upon assembly, the compression housing is preferably snap fit to the ferrule.

Snap fitting is most preferred because of its repeatability, reliability, and ease. Thus, the ferrule, compression housing and portable communicator are constructed so that the compression housing snap fits to the ferrule, and then the ferrule snap fits onto the portable communicator. Preferably, to accommodate snap fit construction, an end of the ferrule includes at least one detent that corresponds to at least one projection on the compression housing. Moreover, another end of the ferrule includes at least one projection that corresponds to at least one detent on the portable communicator. Artisans will appreciate, however, that the ferrule, compression housing, and portable communicator can be constructed so that the arrangement of projections and detents are reversed.

To accommodate two bands, the unitary radiator has a generally helical shape formed by an outer portion thereof and a center portion disposed within the outer portion. Spring force from the compression of the unitary radiator guarantees an electrical connection between the unitary radiator and the ferrule without resort to crimping, soldering or similar techniques. The contact point between the ferrule (or other type of electrical contact) and the unitary radiator is a parallel electrical feed which, when transmitting, excites both portions of the radiator to interact in parallel. When receiving, both portions of the radiator similarly pass signals to the ferrule in parallel. This structure including the unitary radiator permits application of the antenna to stubby mounts, as well as retractable mounts or any mount which can accommodate the compression housing.

BRIEF DESCRIPTION OF THE DRAWINGS

Other features and advantages of the invention will be apparent to those skilled in the art with reference to the detailed description and the drawings, of which:

FIG. 2A is a cross-sectional side view of the fully assembled antenna shown in FIG. 1A;

FIG. 2B is an isometric view of a preferred snap fit ferrule of the present invention;

FIG. 2C is a partial cross-sectional view of an alternate embodiment of the unitary radiator and compression housing of the present invention;

DETAILED DESCRIPTION OF THE INVENTION

Broadly stated, the present invention is directed to an improved multiple band antenna and method of assembling the antenna. The present invention accommodates multiple band with a single radiator. To provide easy, reliable assembly and low manufacturing costs, the antenna allows for snap fit construction, and solderless and crimpless electrical connections.

Figure 1A:
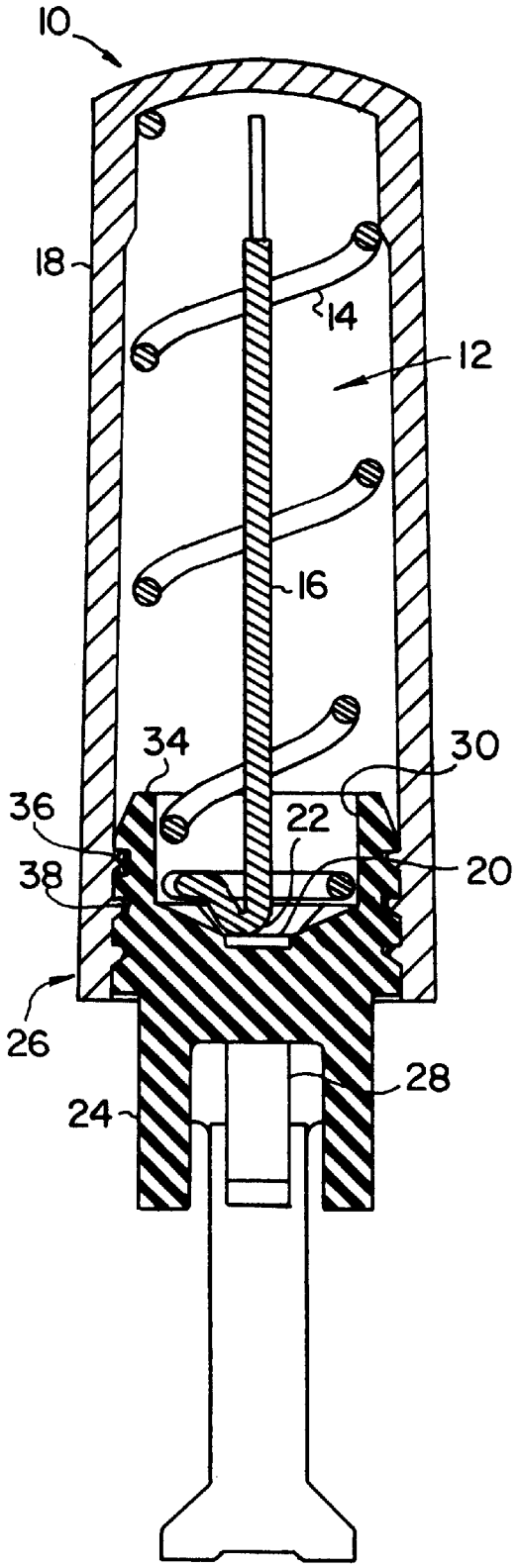
FIG. 1A is a cross-sectional view of a preferred multiple band antenna with unitary radiator and nonconductive ferrule according to the present invention for a snap fit stubby mount.
Figure 1B:
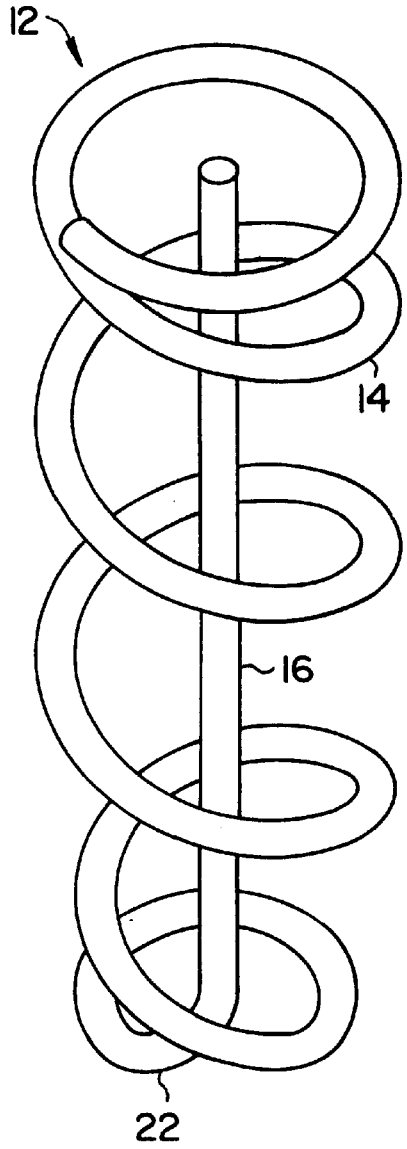
FIG. 1B is an isometric view of the multiple band, unitary radiator of the present invention.

Turning now to the drawings, and particularly FIGS. 1–2, a stubby mount snap fit embodiment of multiple band antenna 10 in accordance with the principles of the invention is shown for a portable communicator such as a cell phone. The antenna 10 includes a unitary radiator 12 having a generally helical shape formed by an outer portion 14 thereof and an inner portion 16 disposed within the outer portion 14 (shown best in FIG. 1B). The inner portion 16 is preferably centered and can extend beyond the helix 14 with appropriate adjustments made to a compression housing 18 (as shown in FIG. 2C).

The unitary radiator 12 operates with multiple bands. One band is realized by outer portion 14 and another by inner portion 16. For example, the inner portion 16 operates at a high frequency such as Personal Communications Systems (PCS) (American Standard, 1850–1990 MHZ) or Digital Communication System (DCS) (European Standard, 1710–1880 MHZ). The outer portion 14 functions at a low frequency such as American Mobile Phone Services (AMPS) (824–894 MHZ) or Groupe System Mobile (GSM) (880–960 MHZ). Artisans will appreciate that the unitary radiator also can be produced to accommodate different frequencies.

The compression housing 18 encloses the unitary radiator 12 and compresses the outer portion 14 when the antenna 10 is assembled. Preferably, the compression housing 18 is hollow to accommodate the unitary radiator 12. It need not be completely hollow, but must permit at least a bottom region of the outer helical portion to compress. Due to the compression of the outer portion 14 of the unitary radiator 12, the unitary radiator 12 reliably contacts an electrical contact 20 with the aid of spring force. The electrical contact 20 forms an electrical connection with circuits of the portable communicator (not shown). Preferably, the unitary radiator 12 contains force suitable for electrical contact when the antenna 10 is assembled to allow for electrical connection to the electrical contact 20. A solderless, crimpless electrical connection is thereby accomplished between the unitary radiator 12 and the circuits of the portable communicator. Accordingly, highly uniform manufacturing results even while realizing a low part count and a simple to assemble antenna 10.

For purposes of operation, the unitary radiator further includes a feed point 22. Preferably, the feed point 22 is generally hook shaped. Alternate shapes are possible, but must preserve the parallel excitation of outer 14 and inner 16 radiator portions. The common feed point 22 thereby excites both portions in parallel in a transmission mode, with a higher frequency signal being radiated from inner portion 16 than is radiated from the outer helical portion 14 due to the shorter physical length of the inner portion 12.

Though a stubby mount antenna 10 is shown in FIG. 1A, artisans will appreciate the general applicability of the multiple band unitary radiator 12 which forms an important part of the invention. It can be incorporated into any antenna structure which is capable of mechanical connection to a suitable compression housing for containing the unitary multiple band radiator 12 and electrical connection to its feed point. Artisans will also appreciate that most benefits of the invention can be obtained with an altered compression housing. Thus, while a snap fit housing 18 is illustrated and has additional advantages, housings having alternate mechanical connection means which result in necessary connection are also suitable. Snap fitting is most preferred because of its repeatability, reliability, and ease.

In the preferred stubby mount embodiment, the ferrule 24 is formed from a nonconductive material. The nonconductive ferrule 24 includes a conductive spring clip 28 (shown best in FIG. 2A), at least a portion of the spring clip 28 being exposed to electrically contact the unitary radiator 12. The particular spring clip and ferrule arrangement also provides a snap fit to a portable communicator. Thus, in the preferred stubby embodiment, the compression housing 18 first snap fits to the ferrule 24 and clip 28 assembly, and the ferrule 24 and clip 28 snap fit onto a portable communicator. The portion of the spring clip 28 disposed on top of the ferrule 24 forms the electrical contact 20 discussed above.

A preferred snap-fit ferrule 24 is shown in FIGS. 2A and 2B. An upper portion of the ferrule 24 includes a recess 30 that accommodates at least a part of the unitary radiator 12. To further accommodate seating of the unitary radiator 12 within the recess 20, a diameter of the outer helical portion 14 of unitary radiator 12 may taper near the feed point 22 to fit within the recess 30 of the ferrule 24. It is also contemplated that a top edge 34 of the ferrule 24 does not contain the recess 30 and the unitary radiator 12 contacts the electrical contact 20 at the top edge 34 of the ferrule 24, as in the FIG. 3 embodiment.

To accommodate snap fit construction, an outside surface of the ferrule 24 includes at least one detent 36 that corresponds to at least one projection 38 on the compression housing 18. Artisans will appreciate, however, that the ferrule 24 could include a projection and the compression housing 18 could include a corresponding detent. Snap fitting is a preferred method of connecting components of the present invention since such an operation reduces the cost and difficulty in assembling the pieces. Threaded connection between the housing 18 and ferrule 24 is also suitable and similarly efficient.

Figure 3A:
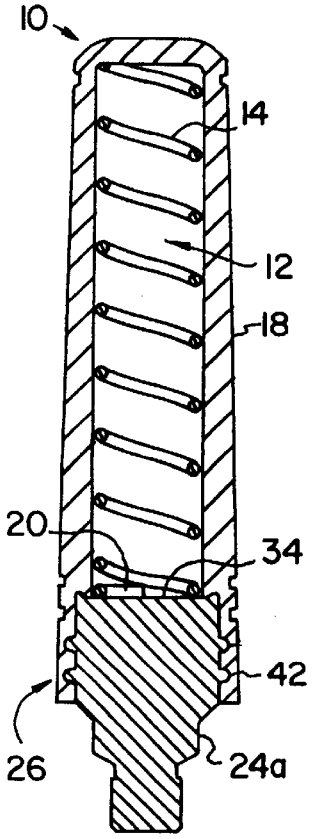
FIGS. 3A and 3B are cross-sectional views of a fully assembled antenna with a conductive ferrule according to the present invention.
Figure 3B:
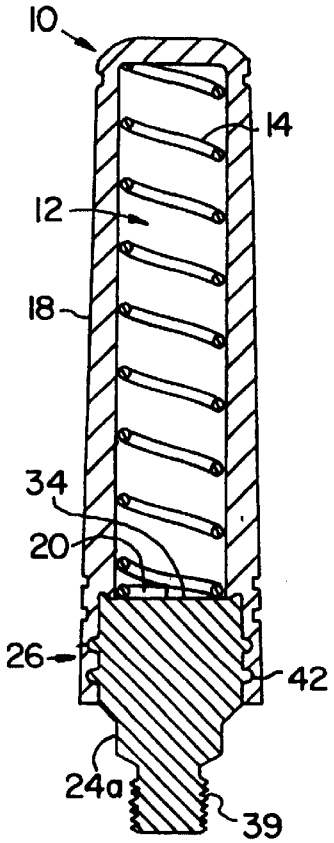

Referring now to FIGS. 3A and 3B, an alternate embodiment of the antenna 10 including a modified conductive ferrule **24*a* is shown. In this embodiment, the conductive ferrule 24*a* is fix mounted, for example, directly to the portable communicator (not shown) to provide an electrical connection between the unitary radiator 12 (shown with single band construction) and circuits within the portable communicator. Alternately, it might be molded into contact with a whip antenna which contacts phone circuits through any suitable means. As shown in FIG. 3A, an end of the ferrule 24 preferably is shaped to allow snap fit assembly of the ferrule 24 to the portable communicator, or molding to a connection piece that threads or otherwise connects to the phone. While snap fitting is the preferred method of assembly, artisans will appreciate that the ferrule 24 may be attached to the portable communicator through other means, such as threads 39 shown in FIG. 3B for screwing the ferrule 24** into the portable communicator.

Figure 4:
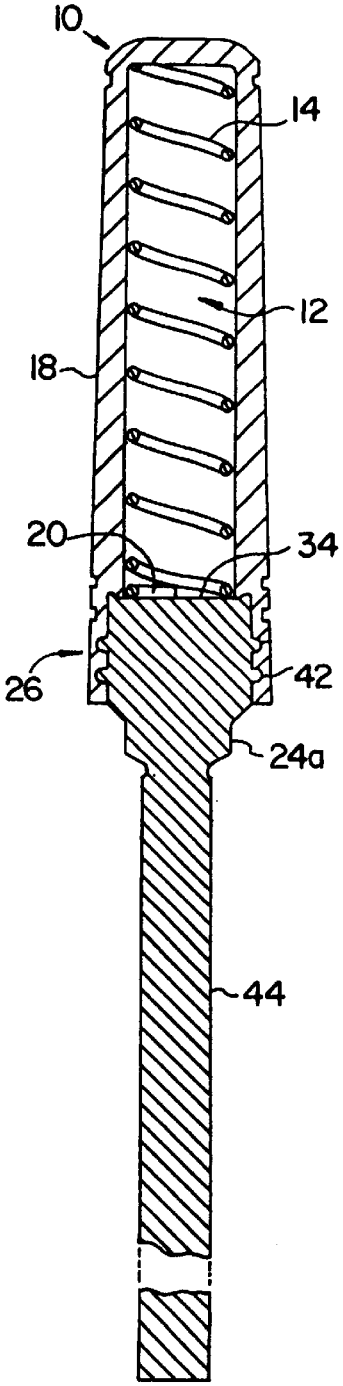
FIG. 4 is a cross-sectional view of a fully assembled antenna with an elongate conductive ferrule according to the present invention.

Referring now to FIG. 4, in another alternate embodiment, the conductive ferrule 24 includes a stem 44 connected near a bottom of the ferrule 24 and generally extending away from the unitary radiator 12 (shown with single band construction). The stem 44 forms, for example, a whip antenna element that might extend from and retract within a portable communicator. Thus, in areas where reception is poor, the antenna 10 might be extended to avoid interference and improve the signal strength, for example, resulting from the head of a human user which can reduce the quality of communications.

The stem 44 may be protectively coated and may make contact with portable communication circuits through a suitable contact at its lower end (not shown) when in an extended position. A sloped portion 42 of ferrule 24*a,* for example, provides a point for electrical contact in a retracted position of the antenna 12, as long as it is left exposed from insulation coating which may cover the remainder of the whip stem 44. The whip stem is in series connection to feed point 22 when in its extended position, and will be active with both portions of unitary radiator 12.

Figure 5A:
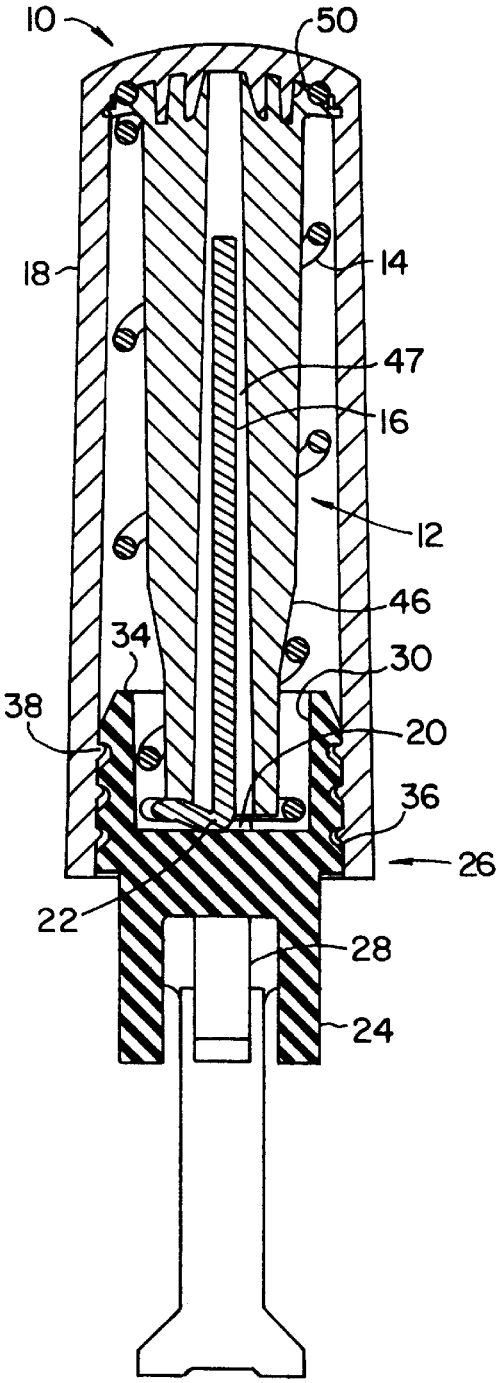
FIGS. 5A and 5B are cross-sectional front and side views of a fully assembled antenna including a core according to the present invention.
Figure 5B:
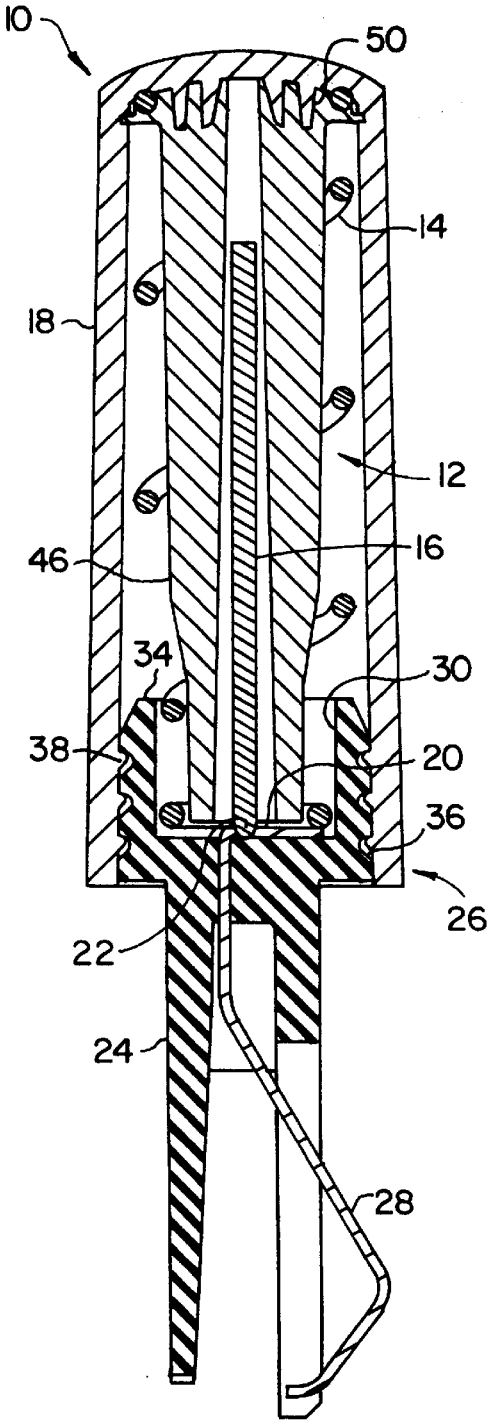

Referring now to FIGS. 5A and 5B, another preferred antenna structure includes a core 46. The core 46 is arranged within a hollow compression housing 18. The outer portion 14 of the unitary radiator generally surrounds the core 46 and the inner portion 16 is disposed with a hollow portion 47 of the core 46. Snap fit assembly is also preferably utilized to secure the core 46 to the compression housing 18.

The antenna of the present invention allows for snap fit assembly, and snap fit assembly is the preferred method of assembling the antenna because of its repeatability, reliability, and ease, as evidenced herein. To assemble the antenna 10, the generally helical shaped unitary radiator 12 of the present invention is placed within compression housing 18. The compression housing 18 then preferably snap fits to a piece defining an electrical contact 20 to compress the helical radiator 12 and electrically connect the radiator 12 and the electrical contact 20. To complete the assembly process, the piece defining the electrical contact 20 preferably snap fits to the portable communicator, and alternately the piece 20 screws to the portable communicator.

From the foregoing description, it should be understood that an improved antenna has been shown and described which has many desirable attributes and advantages. The present invention is adapted to provide a multiple band, single radiator antenna with components that may be easily and reliably assembled to reduce manufacturing cost and increase ease of assembly.

Many alterations and modifications will be apparent to those skilled in the art. Accordingly, the scope of the invention is not limited to the specific embodiments used to illustrate the principles of the invention. Instead, the scope of the invention is properly determined by reference to the appended claims and any legal equivalents thereof.

What is claimed is:

1. A radiator structure for a portable communicator antenna, the structure comprising:

a unitary radiator having a generally helical shape formed by an outer portion thereof and an inner portion disposed within the outer portion;

a compression housing enclosing and compressing said helical portion of said unitary radiator; and an electrical contact contacted by said unitary radiator, said contact being aided by spring force provided by the compression of said helical portion of said unitary radiator.

2. The structure according to claim 1, wherein said compression housing is dimensioned to compress said unitary radiator when said compression housing is secured to a ferrule.

3. The structure according to claim 2, wherein said compression housing snap fits onto said ferrule.

4. The structure according to claim 1, wherein said compression housing is hollow.

5. The structure according to claim 1, wherein a diameter of said outer portion of said unitary radiator tapers towards said electrical contact.

6. The structure according to claim 1, wherein said unitary radiator further comprises a feed point to electrically dispose said outer and inner portions of said unitary radiator in parallel.

7. The structure according to claim 6, wherein said feed point is generally hook shaped.

8. The structure according to claim 1, wherein said outer portion of said unitary radiator radiates and receives lower frequency signals than said inner portion of said unitary radiator.

9. The structure according to claim 1, wherein said outer portion of said unitary radiator extends past a terminal end of said inner portion of said unitary radiator.

10. The structure according to claim 1, wherein said inner portion of said unitary radiator extends past a terminal end of said outer portion of said unitary radiator.

11. An antenna for a portable communicator, the antenna comprising:

a housing;

a ferrule snap fitted to an end of said housing by an end of said ferrule that is shaped to allow snap fit assembly of said ferrule to the housing;

said ferrule further being shaped to allow snap fit assembly of sad ferrule to a portable communicator; and a unitary radiator enclosed by said housing, and compressed between said housing and said ferrule as a result of said ferrule being snap-fitted to said end of said housing.

12. The antenna according to claim 11, wherein an outside surface of said ferrule includes at least one projection to accommodate at least one corresponding detent on said compression housing to allow snap fit assembly of said compression housing to said ferrule.

13. The antenna according to claim 11, wherein said ferrule holds a conductive spring clip, at least a portion of said spring clip being exposed to electrically contact a feed point of said unitary radiator.

14. A method of assembling an antenna for a portable communicator, the method comprising the steps of:

placing a unitary radiator within a compression housing, said unitary radiator having a generally helical shape formed by an outer portion thereof and an inner center portion disposed within the outer portion; and mechanically attaching said compression housing to a piece defining an electrical contact to compress said helical radiator and electrically connect said radiator and said electrical contact.

15. The method according to claim 14, further comprising the step of snap fitting said piece to the portable communicator.

16. An antenna for a portable communicator, the antenna comprising:

a nonconductive ferrule having a snap fit configuration on an upper portion thereof, and forming a snap fit shape away from said upper portion for snap fitting into the portable communicator;

a conductive spring clip held by the nonconductive ferrule, the conductive spring clip being exposed near the upper portion of the nonconductive ferrule and also being exposed from said snap fit shape away from said upper portion; and a housing, the housing being configured to accommodate a helical radiator within, and being shaped to snap fit to said snap fit configuration on said upper portion of said nonconductive ferrule;

the helical radiator being compressed between said ferrule and said housing and in galvanic contact with said conductive spring clip.

17. The antenna according to claim 16, wherein said nonconductive ferrule further comprises a recess for accommodating a lower portion of said helical radiator.

18. An antenna for a portable communicator, the antenna comprising:

a conductive ferrule having a snap fit configuration on an upper portion thereof, and having a conductive stem forming a rod radiator extending away from said upper portion; and a housing, the housing being configured to accommodate a helical radiator within, and being shaped to snap fit to said snap fit configuration on said upper portion of said conductive ferrule;

the helical radiator being compressed between said ferrule and said housing and in galvanic contact with said ferrule.

* * * * *